US006416029B1

(12) United States Patent
Holtermanns

(10) Patent No.: US 6,416,029 B1
(45) Date of Patent: Jul. 9, 2002

(54) SUPPORT FOR DRUMS

(76) Inventor: Jürgen Holtermanns, Bonnengarten 2, 53783 Eitorf (DE)

( * ) Notice: Subject to any disclaimer, the term of this patent is extended or adjusted under 35 U.S.C. 154(b) by 0 days.

(21) Appl. No.: 09/659,271

(22) Filed: Sep. 12, 2000

(51) Int. Cl.[7] ..... A47B 91/00
(52) U.S. Cl. ..... 248/346.06; 84/421
(58) Field of Search ..... 248/127, 146, 248/154, 346.06; 84/421, 411.12, 419, 327

(56) References Cited

U.S. PATENT DOCUMENTS 1,312,771 A * 10/1919 Vogeler ..... 84/421
2,070,082 A * 2/1937 Horak ..... 84/419
2,074,194 A * 3/1937 Strupe ..... 84/419
3,747,463 A * 7/1973 Hinger ..... 84/419
5,335,575 A * 8/1994 Hoshino ..... 84/421
5,467,680 A * 11/1995 Kurosaki ..... 84/421
6,040,514 A * 3/2000 Liao ..... 84/421

FOREIGN PATENT DOCUMENTS

DE 40 06 484 A1 * 9/1991

* cited by examiner

*Primary Examiner*—Ramon O. Ramirez
*Assistant Examiner*—Kofi Schulterbrandt
(74) *Attorney, Agent, or Firm*—Edwin D. Schindler

(57) ABSTRACT

Support for drums of various sizes and shapes comprising a shelf with three or more radial arms, a mounting element at the bottom of the shelf for mounting the support on a stand, and three or more sticks distributedly arranged at the periphery of the shelf and projecting upwards. The support allows playing the drum when the player is standing with the support being mounted on a stand, or sitting with the support standing on the floor.

19 Claims, 4 Drawing Sheets

SUPPORT FOR DRUMS

The invention relates to a support for drums of various sizes and shapes.

Modern drums are based on the traditional instruments from Africa or Latin America and can have different sizes and forms so that different stands for them are necessary for playing them comfortably. Most of the commercially available stands are useful only for a single drum type, e.g. for Conga drums. They are bulky and troublesome in their handling. For adjusting its height position the instrument has to be taken from the stand, and the stand has to be adjusted, possibly several times until the optimum playing height and position is achieved. The hitherto commercially available stands cannot be used when playing in a sitting position.

The object of the invention is to provide a support for drums which is suitable for carrying drums of various sizes and shapes. A further object is to provide a drum support which is compact and collapsible and can easily be transported and stowed. A further object of the present invention is to provide a drum support which can be conveniently handled. Furthermore, the object of the invention is to provide a drum support which can be mounted on a tripod and allows to adjust elevation without removal of the drum from the support. Finally, the drum support should be usable by a sitting player.

According to the invention these objects are achieved by a drum support comprising a shelf with three or more arms, a mounting element at the bottom of the shelf for mounting the shelf on a tripod, and three or more sticks distributedly arranged at the periphery of the shelf and projecting upwards. The support enables the player to arrange for the optimum drum position with respect to height an inclination. The support allows playing optionally when standing (with the support being mounted on a tripod) or sitting (without mounted on a tripod). If the tripod is not used for the support a stool plate instead of the support can be mounted so that a stool for the player is provided. The drum support can remain mounted at the drum in each playing position and when the instrument is transported. This allows a quick setting up and dismantling of the instrument and a space saving as well as a quick change of the playing position for the percussionist.

According to a preferred embodiment of the support its arms are telescopic and their lengths are securable by means of set screws. By this the support can be adapted to drums having different diameters at their bottom. Furthermore the effective length of the arms can be decreased so that the sticks can be introduced through the open bottom into the drum for holding the drum from inside.

Preferably, the tilt angle $\alpha$ of the sticks to the shelf plane is variable. For this the sticks are preferably pivoted at the free ends of said arms so that the stick is swingable in the plane defined by the support axis and said arm. By this means the support can be adapted to differently shaped drums, especially Conga drums with upwards increasing cross section.

Preferably, an adjusting screw connected to a plate above the shelf for supporting the bottom of a drum is arranged in one of said arms. The supporting plate can be lifted by the adjusting screw so that the tilt of the drum can be varied even when the player is sitting. Conveniently, the supporting plate is connected to said adjusting screw via a ball-and-socket joint. In this way the supporting plate is tilted with the inclination of the drum standing on the plate.

In a special embodiment of the support a drum closure plate is fastened at said mounting element on said shelf. The drum usually open at its bottom side can be at least partially closed with use of this closure plate so that drums can be played optionally closed or open. With the stand systems hitherto available this is not possible without any problems.

A further embodiment of the drum support is characterized in that the sticks extend downwards beyond the bottom of the mounting element whereby support feet are formed for using the support of the invention without a tripod or other separate stand. This allows the drum to be plaid by a sitting percussionist without separating it from the support. The said feet assure the sufficient ground clearance for an unaffected sound development.

Conveniently, each foot comprises an adjusting screw, and each arm has a downwards directed stop finger serving as a stop for the adjusting screw. The tilt of the sticks when engaging the drum wall can be limited in this way and consequently adapted to the shape of the drum, especially when upwards divergently formed.

Preferably, the sticks and the arms of the shelf are coated at least partially by an elastic layer. This layer can be made of rubber or plastics. It protects the surface of the instrument so that the optical design of its surface is not impaired. Furthermore any slippage of the drum in the support and any noise generation due to contacts between the drum and the sticks and arms of the support are avoided. For the same purpose the shelf and eventually the drum closure plate can be at least partially coated by elastic layers.

Preferably, the sticks comprise lower parts articulated at the arms, and upper parts which are axially displacable and rotatable in said lower parts and can be extended from them and each have two contact fingers forming an obtuse angle with each other. These telescopic sticks allow the extension so that long drums (having a big axial length) can be stably supported. The axial rotability assures that both contact fingers of each stick automatically engage the drum.

The invention will now be explained in more detail based on the drawings which show exemplified embodiments partly in a schematic illustration.

Figure 1:
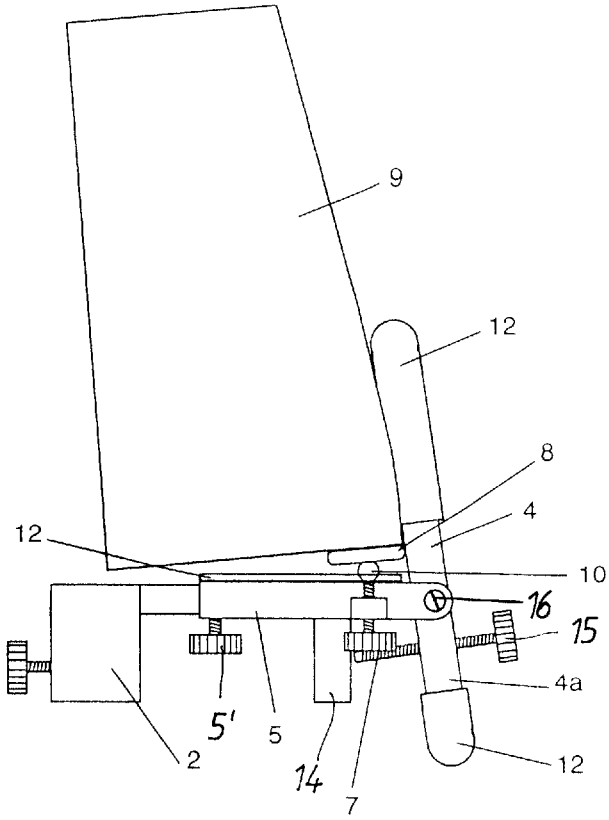
FIG. 1 is a partial side view of a first embodiment of the support.
Figure 2:
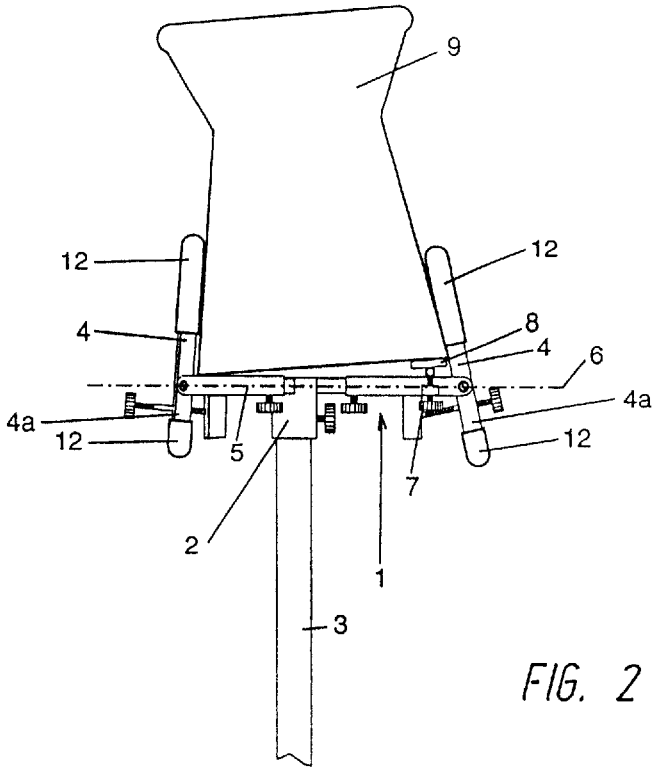
FIG. 2 is a total side view of the support partially shown in FIG. 1 with the total drum.
Figure 3:
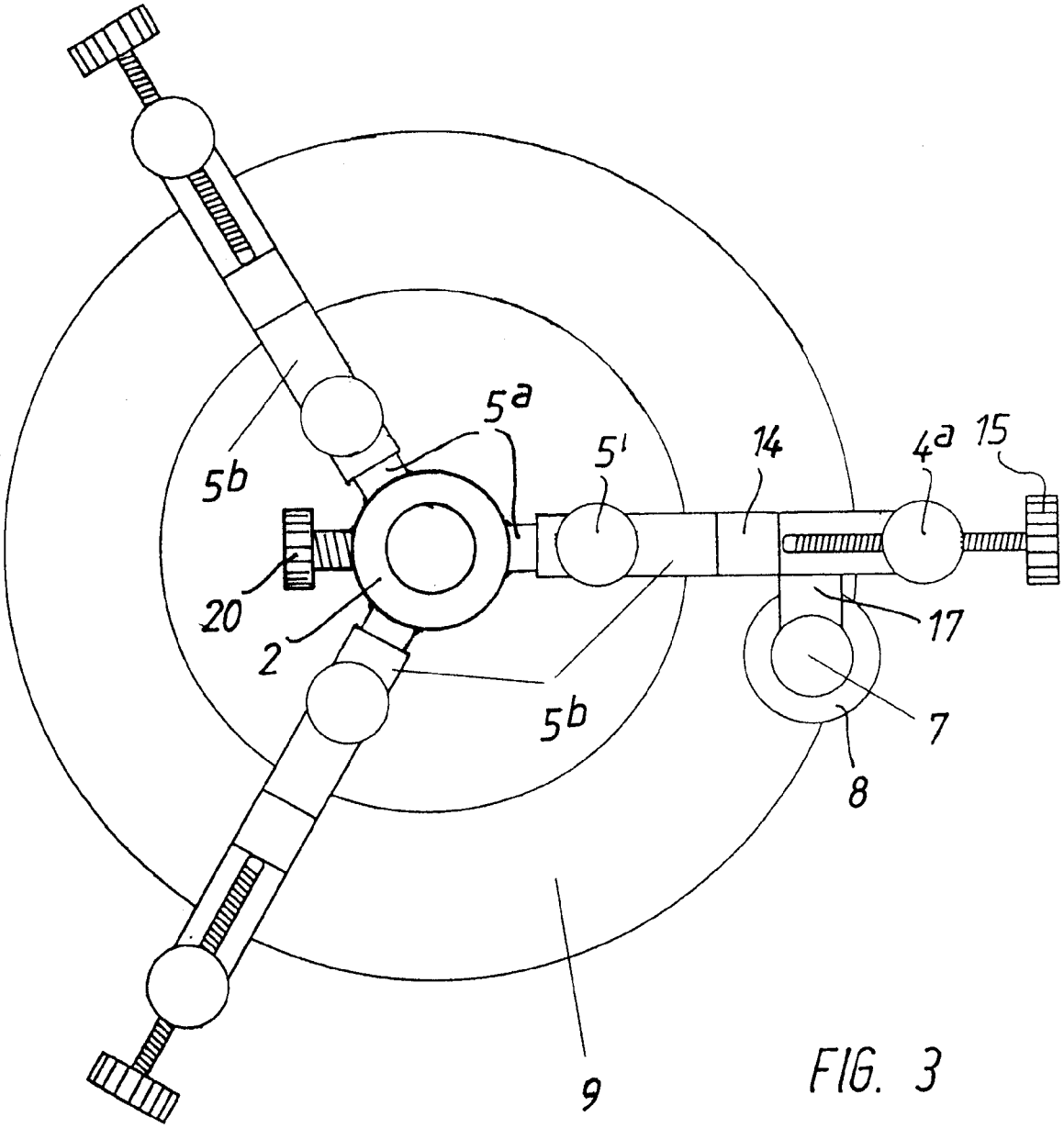
FIG. 3 is the bottom view of the support shown in FIG. 2.

The drum support 1 shown in the FIGS. 1 to 3 comprises a central mounting element 2 adapted to be fastened on the top of a stem of a stand, e.g. a tripod 3. The mounting element 2 is formed with three telescopic arms 5 the extended length of which can be fixed by a set screw 5'. A stick 4 is swingably mounted at the end of each arm 5 with the axis of the hinge 16 being perpendicular to the respective arm 5. The sticks 4 have a downward extension ending beyond the bottom of the central mounting element 2 so that the extension can be used as support feet $\mathbf{4}^a$ if the support is removed from the tripod 3. One of the arms 5 is provided with a vertical adjusting screw 7 which is connected to a supporting plate 8 via a ball-and-socket joint 10. The adjusting screw allows to impart a tilt of the drum with respect to the shelf plane 6 as can be seen from FIGS. 1 and 2. The arms 5 have stop fingers 14 extending vertically downwards, and the stick extensions $4^a$ contain set screws 15 bearing against said stop fingers 14 so that the inclination of the sticks can be varied corresponding to the convergent or divergent shape of the bottom portion of the drum 9. The sticks 4 and the extensions $4^a$ as well as the arms 5 are provided with rubber coatings 12 to protect the drum surface and avoid undesired noises.

The bottom view of the support of FIG. 3 shows the three two-part arms 5 consisting of inner arm parts $5^a$ fixed at the central mounting element 2 and the extensible arm parts $5^b$ carrying the sticks 4,$4^a$ at their free ends. The set screws 5' serve for. setting the extended length of the arms. One of the arm parts $5^b$ bears a cross bar 17 with a tap hole and the adjusting screw 7 by means of which the supporting plate 8 can be lifted or lowered. The screw 20 is used for fastening the shelf 1 on the stem of a tripod.

Figure 4:
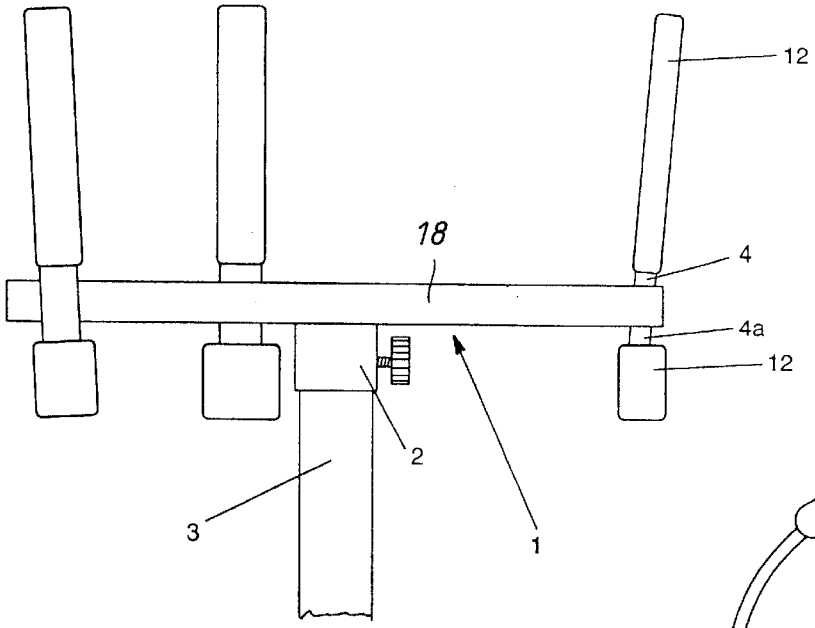
FIG. 4 is the side view of a second embodiment of the support.
Figure 5:
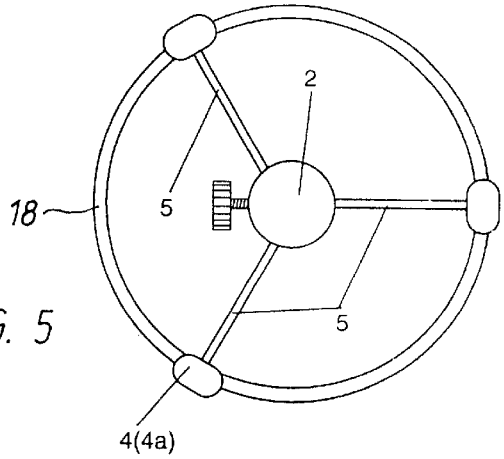
FIG. 5 is a top view of the support shown in FIG. 4.

The FIGS. 4 and 5 show a simplified embodiment of the support which can be used for Conga drums (having a cross section widening upwards). The sticks 4,$4^a$ are correspondingly divergently oriented, but rigidly mounted at the ends of the arms 5 so that the support cannot be adapted to drums of different shape. The ends of the non-extensible arms 5 are connected to each other by means of a ring 18.

Figure 6:
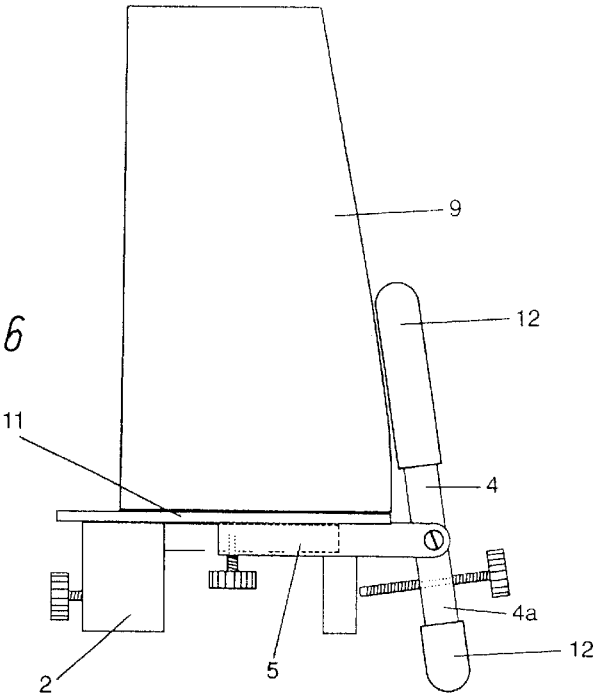
FIG. 6 is a partial side view as in FIG. 1 of a third embodiment of the invention.

The embodiment shown in FIG. 6 differs from the embodiment of FIG. 1 in that the screw 7 and the supporting plate 8 for adjusting the tilt of the drum are omitted. Instead a drum closure plate 11 is fastened on the central element 2. FIGS. 6 and 1 show only the right hand part of the support and the drum.

Figure 7:
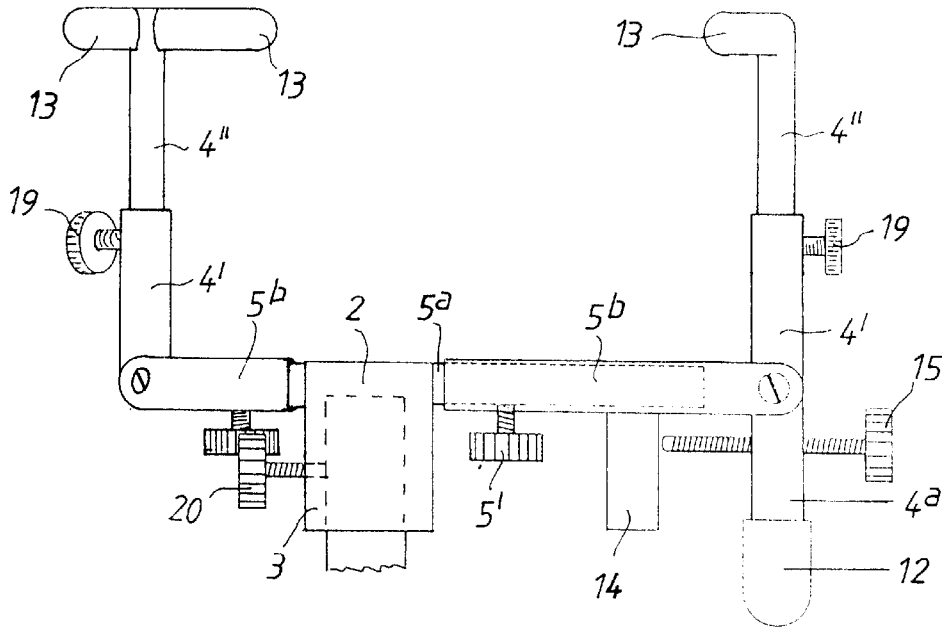
FIG. 7 is a side view of a fourth embodiment of the support with one arm and its stick being omitted.
Figure 8:
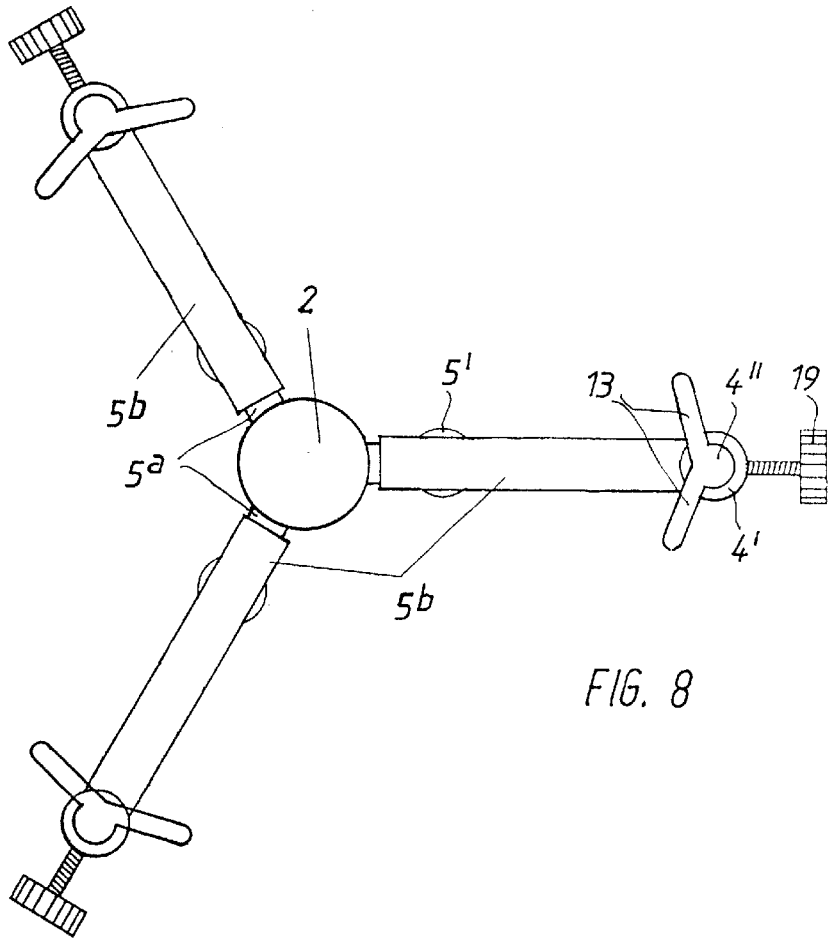
FIG. 8 is a top plan view of the support shown in FIG. 7.

The embodiment of the support shown in FIGS. 7 and 8 differs from the embodiment of FIG. 1 in that the sticks 4 comprise a lower part $4^a$ hinged at the outer arm part $5^b$ and an upper part 4" extensible from part $4^a$ and arranged to be fixed in their extension length by screw 19. The free ends of the extensible stick parts 4" are formed by two contact fingers 13. The two fingers of each stick part 4" form an obtuse angle with each other and engage the out-side of a drum inserted into the support.

What is claimed is:

1. A support for drums of various sizes and shapes, comprising:

a shelf with at least three radial telescopic arms having lengths securable via a set screw;

a mounting element at bottom of said shelf for mounting said shelf on a tripod; and, at least three sticks distributedly arranged at a periphery of said shelf and projecting upwardly.

2. The support for drums according to claim 1, further comprising a drum closure plate fixed at said mounting element on said shelf.

3. The support for drums according to claim 1, wherein said sticks are, at least partially, coated with an elastic layer.

4. A support for drums of various sizes and shapes, comprising:

a shelf with at least three radial arms and a plate;

a mounting element at bottom of said shelf for mounting said shelf on a tripod; and, at least three sticks distributedly arranged at a periphery of said shelf and projecting upwardly, a tilt angle ($\alpha$) of said sticks to the plate of said shelf being variable.

5. The support or drums according to claim 4, further comprising a drum closure plate fixed at said mounting element on said shelf.

6. The support for drums according to claim 4, wherein said sticks are, at least partially, coated with an elastic layer.

7. A support for drums of various sizes and shapes, comprising:

a shelf with at least three radial arms;

a supporting plate above said shelf;

a mounting element at bottom of said shelf for mounting said shelf on a tripod;

at least three sticks distributedly arranged at a periphery of said shelf and projecting upwardly; and, an adjusting screw at one of said radial arms connected to said supporting plate above said shelf for supporting a base of a drum.

8. The support for drums according to claim 7, wherein said supporting plate is connected to said adjusting screw via a ball-and-socket joint.

9. The support for drums according to claim 7, further comprising a drum closure plate fixed at said mounting element on said shelf.

10. The support for drums according to claim 7, wherein said sticks are, at least partially, coated with an elastic layer.

11. A support for drums of various sizes and shapes, comprising:

a shelf with at least three radial arms;

a mounting element at bottom of said shelf for mounting said shelf on a tripod; and, at least three sticks distributedly arranged at a periphery of said shelf and projecting upwardly and extending downwardly beyond the bottom of said mounting element, so that support feet are formed for using said support for drums without a tripod.

12. The support for drums according to claim 11, wherein each support foot of said support feet comprises a set screw, and each of said radial arms has a downwardly directed stop finger serving as a stop for said set screw.

13. The support for drums according to claim 11, further comprising a drum closure plate fixed at said mounting element on said shelf.

14. The support for drums according to claim 11, wherein said sticks are, at least partially, coated with an elastic layer.

15. A support for drums of various sizes and shapes, comprising:

a shelf with at least three radial arms;

a mounting element at bottom of said shelf for mounting said shelf on a tripod; and, at least three sticks distributedly arranged at a periphery of said shelf and projecting upwardly, said sticks comprising lower parts articulated at said radial arms, and upper parts which are axially rotatable in said lower parts and are extendable from said lower parts, said upper parts each having contact fingers forming an obtuse angle with each other.

16. The support for drums according to claim 15, further comprising a drum closure plate fixed at said mounting element on said shelf.

17. The support for drums according to claim 15, wherein said sticks are, at least partially, coated with an elastic layer.

18. A support for drums of various sizes and shapes, comprising:

a shelf with at least three radial arms;

a mounting element at bottom of said shelf for mounting said shelf on a tripod;

a drum closure plate fixed at said mounting element on said shelf; and, at least three sticks distributedly arranged at a periphery of said shelf and projecting upwardly.

19. The support for drums according to claim 18, wherein said sticks are, at least partially, coated with an elastic layer.

* * * * *